US009976097B2

(12) United States Patent
Parrott

(10) Patent No.: US 9,976,097 B2
(45) Date of Patent: May 22, 2018

(54) CHARCOAL IGNITION FLUID

(71) Applicant: InnoVerdant LLC, Tulsa, OK (US)

(72) Inventor: Paul Ray Parrott, Catoosa, OK (US)

(73) Assignee: INNOVERDANT, LLC, Tulsa, OK (US)

( * ) Notice: Subject to any disclaimer, the term of this patent is extended or adjusted under 35 U.S.C. 154(b) by 0 days. days.

(21) Appl. No.: 15/061,533

(22) Filed: Mar. 4, 2016

(65) Prior Publication Data

US 2016/0257899 A1 Sep. 8, 2016

Related U.S. Application Data

(60) Provisional application No. 62/128,445, filed on Mar. 4, 2015.

(51) Int. Cl.

| | |
|---|---|
| ***C10L 9/00*** | (2006.01) |
| ***C10L 9/10*** | (2006.01) |
| ***C10L 1/12*** | (2006.01) |
| ***C10L 1/18*** | (2006.01) |
| ***C10L 11/04*** | (2006.01) |
| *C10L 1/182* | (2006.01) |
| *C10L 1/198* | (2006.01) |

(52) U.S. Cl.

CPC ..... *C10L 9/10* (2013.01); *C10L 1/125* (2013.01); *C10L 1/18* (2013.01); *C10L 11/04* (2013.01); *C10L 1/1824* (2013.01); *C10L 1/198* (2013.01); *C10L 2200/0209* (2013.01); *C10L 2200/0213* (2013.01); *C10L 2200/0254* (2013.01); *C10L 2200/0295* (2013.01); *C10L 2200/04* (2013.01); *C10L 2230/06* (2013.01)

(58) Field of Classification Search

CPC .... C10L 9/10; C10L 1/125; C10L 1/18; C10L 1/1824; C10L 1/198; C10L 2200/0209; C10L 2200/04; C10L 11/04; C10L 2200/0254; C10L 2230/06; C10L 2200/0213; C10L 2200/0295

See application file for complete search history.

(56) References Cited

U.S. PATENT DOCUMENTS

| | | | |
|---|---|---|---|
| 4,365,971 | A | 12/1982 | Monick |
| 4,614,545 | A | 9/1986 | Hess |
| 4,778,826 | A | 10/1988 | Jezi et al. |
| 5,252,107 | A | 10/1993 | Wilkins, Jr. |
| 5,276,231 | A | 1/1994 | Kocal et al. |
| 5,480,984 | A | 1/1996 | Angerer et al. |
| 6,056,793 | A | 5/2000 | Suppes |
| 6,787,577 | B2 | 9/2004 | Davis et al. |
| 6,843,812 | B2 | 1/2005 | Stephanos |
| 7,294,253 | B2 | 11/2007 | DeHaan et al. |
| RE40,419 | E | 7/2008 | Norbeck et al. |
| 7,632,318 | B2 | 12/2009 | Stephanos |
| 7,846,323 | B2 | 12/2010 | Abhari et al. |
| 7,972,392 | B2 | 7/2011 | Eichhorn et al. |
| 8,728,178 | B2 | 5/2014 | Moe et al. |
| 2002/0124461 | A1 | 9/2002 | Stephanos |
| 2002/0129543 | A1 | 9/2002 | Bright |
| 2004/0231237 | A1 | 11/2004 | Boer et al. |
| 2009/0293345 | A1 | 12/2009 | Esen et al. |
| 2011/0008507 | A1 | 1/2011 | Moe et al. |
| 2011/0107947 | A1 | 5/2011 | Vernon |
| 2011/0269654 | A1 | 11/2011 | Marlin |
| 2012/0157725 | A1 | 6/2012 | McAuliffe |
| 2014/0212561 | A1 | 7/2014 | Moe et al. |
| 2015/0111972 | A1* | 4/2015 | Knight ..... C10L 7/04 514/724 |

FOREIGN PATENT DOCUMENTS

| | | |
|---|---|---|
| GB | 1108127 | * 4/1968 |
| JP | 02286789 | * 11/1990 |
| WO | 2013132264 | 9/2013 |

OTHER PUBLICATIONS

Jon Van Gerpen; Biodiesel processing and production; Fuel Processing Technology 86 (2005) 1097-1107.

Maxx Chatsko; British Invasion: Why is America Producing Fuel for This WWII Airplane?; Jan. 25, 2015.

Odorless Kerosene: A Refined Grade of Kerosene; Excerpts from a report published by the National Institutes of Health (May 25, 2013) <http://www.ncbi.nlm.nih.gov/pmc/articles/PMC3664014/>.

Petroleum refining; Published: Oct. 19, 2006, 2:42 pm; Updated: Apr. 30, 2013, 5:36 pm; Source: Eia::OSHA; Topics: Energy.

SIDS Initial Assessment Report for SIAM 13; Bern, Switzerland, Nov. 6-9, 2001.

Material Safety Data Sheet; Smarter Starter Fluid from ESCOGO LLC.

The Dow Chemical Company; METHOCEL Cellulose Ethers, Technical Handbook (Sep. 2002).

Agency for Toxic Substances and Disease Registry; Polycyclic Aromatic Hydrocarbons (PAHs)—ToxFAQs (Sep. 1996).

Wisconsin Department of Health Services; PAHs (Dec. 30, 2015).

Brian Palmer, Slate.com, Cooking Up Cancer? (Jan. 22, 2014) <http://www.slate.com/articles/health_and_science/medical_examiner/2014/01/cancer_risk_from_grilled_meat_is_it_time_to_give_up_smoked_and_fried_foods.html>.

Gautam, M. et al. (1999). "Combustion Characteristics of Higher Alcohol/Gasoline Blends," in The Economic Production of Alcohol Fuels from Coal-Derived Synthesis Gas, U.S. Department of Energy, TR-25 & TR-26, pp. 377-409.

World Health Oranization; "Q&A on the carcinogenicity of the consumption of red meat and processed meat" (Oct. 2015); <http://www.who.int/features/qa/cancer-red-meat/en/#.

* cited by examiner

*Primary Examiner* — Cephia D Toomer
(74) *Attorney, Agent, or Firm* — Crowe & Dunlevy, P.C.

(57) ABSTRACT

The invention relates generally to a charcoal ignition fluid that is composed of a cellulose ether polymer, butanol, and water. The charcoal ignition fluid has performance characteristics similar to petroleum distillate but is more sustainable. Additionally, the charcoal ignition fluid can include ethanol and/or an alcohol to reduce the water content. Moreover, the charcoal ignition fluid can include an acetate salt to increase the visible flame for safety purposes. The charcoal ignition fluid may also include an organic ester to enhance the odor of the ignition fluid.

73 Claims, No Drawings

CHARCOAL IGNITION FLUID

CROSS REFERENCE TO RELATED APPLICATIONS

This application claims priority to and the benefit of U.S. Provisional Patent Application Ser. No. 62/128,445, filed Mar. 4, 2015, which is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention relates generally to a charcoal ignition fluid, and more particularly to a charcoal ignition fluid that is composed of a cellulose ether polymer, butanol, and water that has performance characteristics similar to petroleum distillate, but which does not include and is more sustainable than petroleum distillate.

2. Description of the Related Art

North America is leading the global and sustainable chemicals industry. Consumer demands for greener products are driving retailers, brand owners, and government policy makers to replace petrochemicals and chemicals of concern with safer, bio-based alternatives. New sources of government and private funding are enabling more innovation and scale-up to demonstrations and commercialization stages. Chemicals are receiving an unexpected boost from the shale gas boom, opening the door for drop-in C3-C5 chemicals. Further, chemicals are also not at the mercy of volatile natural gas and oil prices, offering the potential for more stable, or even lower prices than their petrochemical alternatives on a long-term basis.

The petroleum-based charcoal starter fluid that is most widely in use is a petroleum distillate that may contain significant levels of aromatic and sulfur-containing compounds, which affect the quality and safety of food cooked over charcoal ignited with petroleum distillates. Additionally, the petroleum distillate charcoal starter fluids consume a significant quantity of petroleum, a non-renewable fossil fuel.

Charcoal starter fluids incorporating petroleum distillates currently in use have a number of drawbacks relative to consumer and environmental issues. For example, they contain a significant and potentially toxic amount of aromatic compounds. Consumers who do not wait until these toxic compounds burn off adequately before placing food over charcoal ignited with petroleum distillates may unknowingly contaminate the food with carcinogenic residues from the incomplete combustion of the fluid still contained in the charcoal. The sulfur-containing compounds in petroleum distillate can also form noxious odors and flavors that are absorbed by food placed in a charcoal cooker.

In addition, recent animal and laboratory studies suggest that heterocyclic amines ("HCAs") may damage DNA and spur the development of tumors in cells of the colon, breast, kidneys, prostate and lymph system. Polycyclic aromatic hydrocarbons ("PAHs") are generated from the incomplete combustion of petroleum hydrocarbons and even poorly oxygenated bio-based hydrocarbons that are currently used in charcoal ignition fluids. At temperatures of 350° F. and hotter, amino acids and creatine (a natural compound that helps supply energy to muscles and nerves) react to form HCAs. Accordingly to recent studies, PAHs form when fat drips onto hot coals, creating smoke that settles on food; these compounds have been associated with increased risk of various forms of cancer. When PAHs from a flame mingle with nitrogen, say from a slab of meat, they can form nitrated PAHs ("NPAHs"). NPAHs are even more carcinogenic than PAHs in laboratory experiments.

In order to be easily ignited, the charcoal starter fluid composed of petroleum distillates must have a flashpoint that is low enough, typically 103° F. to 107° F. (Tag Closed Cup). Charcoal starter fluids with flashpoints below 100° F. are more regulated based on being more hazardous to use. Charcoal starter fluids with flashpoints higher than 110° F. are typically too difficult to be ignited, and are therefore, not accepted by consumers.

The presence of certain hydrocarbon species in petroleum-based, charcoal starter fluid causes it to emit significant levels of volatile organic compounds ("VOC") into the atmosphere. The presence of aromatic and cyclic hydrocarbons produce evaporative emissions prior to ignition, as well as those caused by incomplete combustion after ignition. A charcoal starter fluid that does not contain a significant amount of these compounds and that contains higher levels of hydrocarbons that undergo more complete combustion when ignited produce much lower emissions of VOCs.

It is therefore desirable to provide a charcoal ignition fluid that is composed of a blend of renewable hydrocarbons and cellulose polymers for the ignition of charcoal in both briquette and lump forms.

It is further desirable to provide a charcoal ignition fluid that is composed of a cellulose polymer, butanol, and water having performance characteristics similar to petroleum distillate but which is more sustainable than petroleum distillate.

It is further desirable to provide a charcoal ignition fluid that replaces the petroleum distillate currently in wide use as a means of igniting charcoal in both briquettes and lump forms.

It is yet further desirable to provide a charcoal ignition fluid that replaces the hydrocarbon made from petroleum, a non-renewable resource, by mimicking the physical characteristics of the distillate so closely that the typical consumer can use it in the same manner to which they are accustomed when using petroleum distillate with no perceived compromise in the way it performs.

It is still further desirable to provide a charcoal ignition fluid that is lower in noxious odors and the tendency to product off-flavors compared to petroleum distillate-based charcoal starter fluids.

It is yet further desirable to provide a charcoal ignition fluid having a renewable status that makes it more sustainable on a raw material basis.

It is still yet further desirable to provide a charcoal ignition fluid having a decreased toxicity concern due to the absence of aromatic compounds, such as toluene, xylene, and benzene.

It is still yet further desirable to provide a charcoal ignition fluid composed without aromatic and sulfur-containing compounds, which can affect the flavor and odor of foods cooked over charcoal.

It is still yet further desirable to provide a charcoal ignition fluid that meets VOC emission levels that are permissible according to the South Coast Air Quality Management District Rule 1174 (1991), as codified by the charcoal lighter material testing protocol in 40 C.F.R. 59.208.

Moreover, in light of recent government reports indicating the presence of cancer causing compounds in meats grilled at high temperatures over charcoal and other fuels, it is still yet further desirable to provide a charcoal ignition fluid having an increased ability to minimize the amount of carcinogens generated by the incomplete combustion of petroleum hydrocarbons and even longer carbon chain fuels.

Other advantages and features will be apparent from the following description, and from the claims.

SUMMARY OF THE INVENTION

In general, in a first aspect, the invention relates to a charcoal ignition fluid containing cellulose ether polymer, butanol and water. The cellulose ether polymer has a 3:1 carbon-to-oxygen ratio, and may have a low or ultra-low viscosity, particularly between approximately 3.0 cSt and approximately 7.5 cSt at 110° F. or of between approximately 8 seconds and approximately 17 seconds as measured at 70 degrees by Zahn Tube #2. The cellulose ether polymer may be generally both hydrophilic and hydrophobic, and selected from ethyl cellulose, hydroxyethyl cellulose, hydroxypropyl methylcellulose, hydroxypropyl cellulose, hydroxybutyl methyl cellulose, hydroxyethyl cellulose, hydroxyethyl methylcellulose, hydroxypropyl starch or a mixture thereof. When hydroxypropyl methylcellulose is used, it may contain approximately 18 percent to approximately 32 percent by weight methoxyl, approximately 5 percent to approximately 28 percent by weight hydroxypropyl, and approximately less than 8 percent by weight sodium chloride. The butanol in the charcoal ignition fluid may be biobutanol, synthetic butanol, semi-synthetic butanol, cellulose- or grain-derived n-butanol, n-butanol produced by the catalyst reforming of ethanol, n-butanol produced from hydroformulation with propylene, 2-butanol, isobutanol or a mixture thereof.

Further, the charcoal ignition fluid may include an acetate salt, such as sodium acetate, potassium acetate, calcium acetate or a mixture thereof. The charcoal ignition fluid can also incorporate an organic ester, such as butyl acetate, n-butyl acetate or a mixture thereof. In addition, the charcoal ignition fluid may include ethanol and/or a primary amyl alcohol, such as pentanol, 1-pentanol, 2-pentanol, 2-methyl-1-butanol, 3-methyl-1-butanol, 2,2,-dimetheyl-1-propanol or a mixture thereof.

Moreover, in accordance with the first aspect, the charcoal ignition fluid may be comprised of approximately 0.4 percent to approximately 15 percent by weight of the cellulose ether polymer, approximately 70 percent to approximately 95.6 percent by weight butanol, and approximately 4 percent to 15 percent by weight water. Additionally, the charcoal ignition fluid can include between approximately 1 to approximately 20 percent by weight ethanol, less than approximately 2 percent by weight of the primary amyl alcohol, namely pentanol, 1-pentanol, 2-pentanol, 2-methyl-1-butanol, 3-methyl-1-butanol, 2,2,-dimetheyl-1-propanol or a mixture thereof, up to approximately 12 percent by weight of the acetate salt, namely sodium acetate, potassium acetate, calcium acetate or a mixture thereof, and/or up to approximately 11 percent by weight of the organic ester, namely butyl acetate, n-butyl acetate or a mixture thereof.

In general, in a second aspect, the invention relates to a charcoal ignition liquid having approximately 1.2 percent to approximately 2.5 percent by weight of a hydrophilic and hydrophobic cellulose ether polymer, approximately 85.95 percent to approximately 92.85 percent by weight butanol, and approximately 5.95 percent to approximately 11.55 percent by weight water. Furthermore, in accordance with the second aspect, the charcoal ignition liquid may include up to about 7 percent by weight ethanol, up to about 2 percent by weight of a primary amyl alcohol, such as pentanol, 1-pentanol, 2-pentanol, 2-methyl-1-butanol, 3-methyl-1-butanol, 2,2,-dimetheyl-1-propanol 1 or a mixture thereof, up to about 7 percent by weight an acetate salt, such as sodium acetate, potassium acetate, calcium acetate or a mixture thereof, and/or up to about 7 percent by weight an organic ester, such as butyl acetate, n-butyl acetate or a mixture thereof. Similar to the first aspect, the cellulose ether polymer may be a low or ultra-low viscosity cellulose ether polymer, such as ethyl cellulose, hydroxyethyl cellulose, hydroxypropyl methylcellulose, hydroxypropyl cellulose, hydroxybutyl methyl cellulose, hydroxyethyl cellulose, hydroxyethyl methylcellulose, hydroxypropyl starch or a mixture thereof. Additionally, the butanol may be biobutanol, synthetic butanol, semi-synthetic butanol, cellulose- or grain-derived n-butanol, n-butanol produced by the catalyst reforming of ethanol, n-butanol produced from hydroformulation with propylene, 2-butanol, isobutanol or a mixture thereof.

DETAILED DESCRIPTION OF THE INVENTION

The compounds and methods discussed herein are merely illustrative of specific manners in which to make and use this invention and are not to be interpreted as limiting in scope.

While the compounds and methods have been described with a certain degree of particularity, it is to be noted that many variations and modifications may be made in the details of the sequence, components, concentrations and the arrangement of the processes and compositions without departing from the scope of this disclosure. It is understood that the compounds and methods are not limited to the embodiments set forth herein for purposes of exemplification.

A charcoal ignition fluid is provided that is composed of a cellulose ether polymer, butanol and water. The cellulose ether polymer may have a 3:1 carbon-to-oxygen ratio thereby allowing for an efficient combustion with lower air pollution in the form of VOCs. The cellulose ethers are water-soluble polymers derived from cellulose, and are recycled byproducts from construction products, ceramics, paints, foods, cosmetics and pharmaceuticals. Any suitable cellulose ether polymer may be utilized with the charcoal ignition fluid disclosed herein, including ethyl cellulose, hydroxyethyl cellulose, hydroxypropyl methylcellulose ("HPMC"), hydroxypropyl cellulose, hydroxybutyl methylcellulose, hydroxyethyl cellulose, hydroxyethyl methylcellulose, and/or hydroxypropyl starch.

The cellulose ether polymer may be a low viscosity or ultra-low viscosity cellulose ether having a molecular weight of less than about 15,000. If a lower molecular weight cellulose ether polymer is desired, an iron-based catalyst and hydrogen peroxide may be used to hydrolyze the cellulose ether polymer to a predetermined molecular weight. Molecules of soluble cellulose ether polymer in butanol/water mixtures with an average molecular weight of less than 1000 are extremely mobile within the highly fluid mixtures (liquids) with butanol and water. While hydrogen bonding between adjacent molecules of cellulose ether and between molecules of cellulose ether and butanol still occurs, the molecules of hydroxypropyl methylcellulose are extremely mobile within the solution formed in the charcoal ignition fluid disclosed herein. Because the cellulose ether polymers have both hydrophilic and hydrophobic properties, they rapidly migrate to the air/liquid interface of the charcoal ignition fluid to create the unique properties that enable the fluid to effectively mimic odorless kerosene in charcoal ignition. The viscosity of the low viscosity or ultra-low viscosity cellulose is determined by 2% concentration in water using a Brookfield DV2T Viscometer with an ultra-low adapter at 12 rpm, Spindle No. 0.

Furthermore, should the flame produced by the charcoal ignition fluid be too faint in color to assure that it is sufficiently noticeable for safety purposes, the addition of an acetate salt of sodium, potassium and/or calcium may be added. Although the charcoal ignition fluid is not limited to those compounds, the method by which these additives produce a more visible yellow flame involves emitting light in the yellow wavelength spectrum that results from exciting (burning) vaporized atoms of sodium, potassium and/or calcium. This mechanism is designed to ensure the improved safety of the invention over petroleum distillates which produce a yellow flame color as a result of more incomplete combustion, which is known to emit cancer-causing PAHs and other compounds.

In addition to the cellulose ether, the ignition fluid also includes butanol, such as synthetic, semi-synthetic, biobutanol, cellulose- or grain-derived n-butanol, n-butanol produced by the catalyst reforming of ethanol, n-butanol produced from hydroformulation with propylene, 2-butanol, isobutanol or a mixture thereof, and water. In order to create a bio-based charcoal ignition fluid, the butanol may be produced by acetone-butanol-ethanol ("ABE") fermentation process and contain very low or undetectable levels of certain contaminants, such as butyraldehyde (detectable by the human nose at 0.6 ppb) present in petroleum-derived normal butyl alcohols, which tend to cause less favorable odors to consumers. The charcoal ignition fluid, however as noted above, may also be formulated with synthetic or semi-synthetic butanol or other n-butanol derived from propylene or other less renewable feedstocks.

In addition, the charcoal ignition fluid may include ethanol and/or a primary amyl alcohol that is compatible with the cellulose ether polymers in the ignition fluid, such as pentanol, 1-pentanol, 2-pentanol, 2-methyl-1-butanol, 3-methyl-1-butanol, 2,2,-dimetheyl-1-propanol, in a weight percentage that reduces the amount of water. The ethanol may be a specially denatured form of ethanol that is denatured with butanol.

Because oxygen is contained in the molecular structures of butanol and cellulose ether polymer, combustion of the charcoal ignition fluid disclosed herein burns much more efficiently than un-oxygenated hydrocarbons, such as those contained in petroleum distillates, coal and less oxygenated esters of fatty acids derived from animal or plant sources, such as fatty acid esters that contain 1 to 3 oxygen atoms in a 16 to 24 carbon atom chain. Moreover, the oxygen content of the charcoal lighter fluid disclosed herein combined with the atmospheric oxygen creates a combustion model (under lean fuel conditions) that results in emissions of only carbon dioxide and water with only trace non-toxic residues of incomplete combustion.

Additionally, the charcoal ignition fluid is not in gelled form but rather is a low or ultra-low viscosity liquid solution of cellulose ether polymer, butanol, and water. The charcoal ignition fluid can easily be ignited in the same manner as standard charcoal starter fluid (petroleum distillate or kerosene), with a match or butane lighter. In addition, toxicity is greatly reduced as it relates to food contamination and potential poisoning by direct contact with the fluid, and the charcoal ignition fluid contains only oxygenated hydrocarbons and therefore meets and exceeds the regulations of 40 C.F.R. 59.208. The charcoal ignition fluid disclosed herein does not contain higher molecular weight hydrocarbons, such as terpenes, vegetable oil, fatty acid esters, or other compounds, that do not burn efficiently at low temperatures and which produce much higher levels of higher molecular weight VOCs during combustion.

Further, the cellulose ether polymer of the ignition fluid does not increase the viscosity appreciably but rather functions to change the flash point, combustion characteristics and surface properties of the fluid as well as the adhesion properties it exhibits relative to the surface of charcoal of various types, e.g., pressed briquettes, hardwood lump. The charcoal ignition fluid has a flash point, evaporation rate, low viscosity, and surface tension adequate to effectively mimic the properties of petroleum distillate of the type commonly used as charcoal starter fluid, but matches or surpasses the consumer appeal of petroleum distillate based on the absence of noxious odors and/or residual effects on food tastes.

Some of the follow exemplary formulations of the charcoal ignition fluid provide for a generally blue flame during combustion that may be barely visible to a consumer, and therefore could present a potential hazard to consumers who are accustomed to seeing a bright yellow flame when using petroleum distillate as a charcoal starter fluid. This yellow flame is the result of incomplete combustion of the hydrocarbons that comprise petroleum distillate, a cause for concern relative to the emission of toxic compounds and VOCs that can contaminate surfaces contacted by food or the food itself during cooking. Some compounds emitted by the burning of petroleum distillate charcoal starter fluids have been shown to cause cancer in laboratory animals. The charcoal ignition fluid disclosed herein produces very little smoke and may find additional uses as a means of starting wood in indoor fireplaces and in wood pellet heaters and stoves.

In order to produce the bright yellow flame consumers are so used to seeing and which provides the visibility that the charcoal has been ignited, addition of an acetate salt to the charcoal ignition fluid provides for a highly visible yellow colored spectrum of light to be emitted in the flame when the dissolved acetate salt burns. The charcoal ignition fluid may include up to about 12% by weight of the acetate salt, such as sodium, potassium, and/or calcium acetate, which is oxidized into non-toxic compounds that emit far fewer VOCs than petroleum distillate and far fewer metallic oxides than does the charcoal during combustion.

Furthermore, petroleum distillate is generally considered to have a somewhat noxious odor, which is replaced by a lower, less offensive odor with a slightly "sweet" alcohol note in the charcoal ignition fluid disclosed herein. The absence of compounds that can alter the taste and/or odor of foods cooked on charcoal ignited with starter fluid is among the major benefits of the charcoal ignition fluid disclosed herein. The addition of up to about 4 percent by weight of an ester to the ignition fluid serves to further improve the odor of the fluid to be more acceptable to consumers. The ester may be an organic ester derived from sustainable all-natural resources or esters chemically synthesized identical to all-natural esters, such as butyl acetate and/or n-butyl acetate.

These safety features of the charcoal ignition fluid are produced without emitting the toxic hydrocarbon such as those produced from the incomplete combustion of petroleum distillate. And, because the compounds of the ignition fluid herein can be produced from highly sustainable and even renewable sources, they do not diminish the highly sustainable nature of the charcoal ignition fluid. The sodium and calcium portions of the acetate salts dissociate in the butanol/water solution so that they are oxidized completely during combustion of the charcoal ignition fluid. The byproducts of the combustion (oxidation) of sodium and calcium ions are low levels of non-toxic oxides and carbonates, which are much lower in concentration than similar byproducts emitted by the charcoal during combustion. In addition, the acetate ions of the salts are converted into carbon dioxide and water in the presence of the alcohol during combustion.

Moreover as noted above, the charcoal ignition fluid is not a gelled form, but rather flows, pours, squirts and absorbs into charcoal briquettes, lump charcoal, and/or wood pellets, in a manner very similar to petroleum distillate so that the consumer is not required to change any of the typical handling practices developed as a result of years of using petroleum distillate starter fluid. The volatile properties of the charcoal ignition fluid match or diminish the "flash back" characteristic of petroleum distillate so that no perceptible change in safety procedures is required. Therefore, the same dispensing bottles/containers can be used with the charcoal ignition fluid disclosed herein. Additionally unlike petroleum distillate, the charcoal ignition fluid can be stored in an eco-friendly polyethylene terephthalate ("PET" or "PETE") or high density polyethylene ("HDPE") container, which is made of recycled materials and/or can be recycled easily when empty. Petroleum distillate must be packaged in either a metal can (hard to squeeze) or polyvinyl chloride plastic bottles. Further, unlike oily, water-insoluble petroleum distillate, the charcoal ignition fluid can be flushed from the skin or eyes with water very easily. Additionally, the acetate salt optionally used in the charcoal ignition fluid is relatively pH neutral and is present at such low concentration that it will not irritate skin.

EXAMPLES

The charcoal ignition fluid disclosed herein is further illustrated by the following examples, which are provided for the purpose of demonstration rather than limitation. Although hydroxypropyl methylcellulose was used in the following examples due to its relatively low cost and high functionality, a number of other cellulose ether polymers can be used. Other forms of cellulose ethers were evaluated and found to perform in a similar manner when selected on the basis of molecular weight, substitution of side chains and the ability to adjust concentration.

Example 1—Formulations

One-hundred grams (100 g) of normal butyl alcohol ("NBA") was placed in a 400 ml beaker free of any particulate contamination and stirred at a moderate rate using a variable-speed magnetic stirrer plate with adjustable heat settings. Fifty grams (50 g) of ethanol was then added, ensuring that dispersion was complete. Five grams (5 g) of water-soluble hydroxypropyl methylcellulose polymer having a molecular weight of about 10,000 (The Dow Chemical Co., METHOCEL E5) was slowly added, and then agitation was increased until the polymer fully dispersed in the solution. Fifty grams (50 g) of distilled water was added, and turbidity was observed during continued mixing of the solution until turbidity was completely gone, unless the viscosity increased too much as evidenced by the inability of the stirrer bar to keep up with the plate rpm setting. A Brookfield DV2T Viscometer was used to measure viscosity as low as 0.5 cps up to 10 cps @ 12 rpm.

When the liquid was completely clear, an additional 77.5 g of NBA was slowly added in small increments. If the turbidity that resulted did not clear after a few minutes to one hour, NBA additions were discontinued and the remaining weight of NBA was measured on the scales and recorded. Alternatively, the additional 77.5 grams of NBA was placed in a burette and slowly added in precise 10 ml increments to determine the solubility limits of the polymer in the solution. Once all the NBA had been added to the solution and the solution cleared completely, the temperature and viscosity were measured and record. The beaker was covered during mixing and in between additions to avoid losses due to evaporation. Subjective observations were noted regarding the odor level coming from the beaker before adding the polymer and after a clear solution had been formed.

TABLE 1

| Formulation | NBA (% by weight) | EOH (% by weight) | $H_2O$ (% by weight) | HPMC (% by weight) | Flashpoint (° F.) | Viscosity (cSt) | Viscosity (Zahn Cup 2) | Specific Gravity | Vol. Absorbance (mL/gram briquette) | Capillary (mm) |
|---|---|---|---|---|---|---|---|---|---|---|
| 712072.2151 | 63 | 18 | 18 | 1 | N/A | | | | | |
| BL78/ 15.8/4/2/2 | 72.3 | 19.14 | 6.31 | 2.04 | N/A | | | | | |
| 022114 | 71 | 20 | 7 | 2 | 93.2 | | | | | |
| 022114A | 73 | 18 | 7 | 2 | | | | | | |
| 022114B | 73 | 20 | 5 | 2 | | | | | | |

TABLE 1-continued

| Formulation | NBA (% by weight) | EOH (% by weight) | $H_2O$ (% by weight) | HPMC (% by weight) | Flashpoint (° F.) | Viscosity (cSt) | Viscosity (Zahn Cup 2) | Specific Gravity | Vol. Absorbance (mL/gram briquette) | Capillary (mm) |
|---|---|---|---|---|---|---|---|---|---|---|
| XP1.1 | 86.78 | 2.05 | 8.98 | 2.19 | 102 | | 17" | .801 | N/A | |
| XP1.1NT | 87 | 1.8 | 9 | 2.2 | 105 | | 16" | .822 | N/A | 8 |
| XP1.2NT | 87.17 | 1.8 | 9.02 | 2 | 104 | 13 | 15" | .833 | 6.5/52.37 | 10 |
| XP1.3NT | 88.18 | 1.8 | 9.02 | 1 | 100 | | 14" | | 9.5/52.37 | 9 |
| XP2.0NT | 87 | 1.8 | 9 | 2.2 | 104 | 7.42 | 16" | .83 | N/A | 14 |
| XP2.1NT | 87 | 1.5 | 9.5 | 2 | 110 | 6.56 | 15" | .83 | N/A | 10 |
| XP2.2NT | 88 | 1.0 | 9 | 2 | 105 | 6.64 | 15" | .83 | 7/47.5 | 13 |
| Kingsford (Control) | | | | 0 | 105/111 | 1.38 | 15" | .776 | 16/52.37 | 10 |

By milling hydroxypropyl methylcellulose in a micro-grinding mill, the HPMC can be reduced to such a low viscosity in solution that levels high enough to increase the yellow flame color can be attained without exceeding the viscosity required to allow for adequate absorbance of the fluid into the charcoal briquettes or other fuels.

Additionally, a hydrolysis method with an iron catalyst may be utilized further reduce the molecular weight of the cellulose ether polymer component of the charcoal ignition fluid. By lowering the molecular weight of the HPMC, the percent weight content of cellulose ether polymer in the charcoal ignition fluid can be increased without increasing viscosity so that the charcoal ignition fluid disclosed herein more closely mimics the properties of odorless kerosene. These properties include creating a yellow flame and helping to form a kerosene-like film on charcoal that is absorbed into the charcoal surface more quickly by capillary action.

In the process of using this hydrolysis method of reducing the molecular weight of the specific cellulose ether polymer, an insoluble hydrolysate of the cellulose ether polymer may occur that is the result of random cleavage points on the cellulose backbone of the cellulose ether polymer. To minimize the haziness or cloudy appearance this may lend to the fluid, these n-butanol insoluble particles may need to be filtered out with a standard sock or cartridge filter. Any remaining cellulose ether polymer present is determined by a colorimetric test method, and then the cellulose ether polymer content is adjusted, as needed, to meet the particular specifications established for performance purposes. The finished product is adjusted for predetermined chemical and physical properties, and the resulting charcoal ignition fluid is shelf stable for up to three years even when subjected to temperatures below −36° F.

Further, the addition of the higher percentage of cellulose ether polymer in the form of the unique hydrolyzed form allows the fluid to contain less water while maintaining a flash point above 102° F. This, in turn, allows for a higher relative butanol content relative to the water content in the fluid, which improves the combustion characteristics for the specific purpose of igniting charcoal.

Moreover, the addition of hydrolyzed cellulose ether polymer also improves the visibility of the flame by increasing the intensity of yellow coloration relative to a higher appearance of blue color that would be produced by n-butanol alone. A byproduct of the hydrolysis reaction of the polymer is sodium acetate and/or potassium acetate due to the process of neutralizing acetic acid used in the hydrolysis reaction in order to prevent further hydrolysis. The sodium and/or potassium ions present in amounts of about 0.1 to about 5 percent by weight concentrations add to the production of a yellow flame upon combustion without any negative effects. This is one of the unique aspects of the charcoal ignition fluid, which allows consumers to benefit from a cleaner burning starter fluid that still provides a highly visible yellow flame as a safety feature. By maximizing the combustible portion of the formulation in the form of butanol and cellulose ether while minimizing the amount of water needed to solubilize the cellulose ether and elevate the flash point above 100° F., the charcoal ignition fluid produces a flame for a duration period indistinguishable from that of the odorless kerosene traditionally used as charcoal starter fluid.

Example 2—Flash Point

The charcoal ignition fluids of Example 2 were prepared using a similar method of Example 1, and the results illustrated in Table 2 demonstrate that utilizing a cellulose ether polymer having a lower molecular weight of about 5,000 reduces or eliminates the need to add ethanol to the charcoal ignition fluid in order to enhance the solubility of the polymer in butanol. As such, cellulose ether polymers having a molecular weight lower than about 5,000 improve the fuel value of the charcoal ignition fluid by reducing the required water content. As such, depending on the molecular weight and viscosity of the cellulose ether, the polymer can be present in the charcoal ignition fluid up to about 15% by weight.

TABLE 2

| HPMC (% by weight) | NBA (% by weight) | $H_2O$ (% by weight) | Viscosity (cps*) | Flash Point (F°) | Appearance |
|---|---|---|---|---|---|
| 2.5 | 85.95 | 11.55 | 23 | 111.2 | Clear amber |
| 2.2 | 87.3 | 10.5 | 19 | 110.3 | " |
| 2.0 | 88.55 | 9.45 | 17 | 109.6 | " |
| 1.8 | 89.45 | 8.75 | 15 | 108.2 | " |
| 1.6 | 91.1 | 7.35 | 12.5 | 106.7 | " |
| 1.2 | 92.85 | 5.95 | 11 | 104.4 | " |
| 0 | 86.6 | 13.4 | 3 | 111.2 | Clear |
| 0 | 87.9 | 12.1 | 3 | 110.2 | " |
| 0 | 89.12 | 10.88 | 3 | 109.4 | " |

TABLE 2-continued

| HPMC (% by weight) | NBA (% by weight) | $H_2O$ (% by weight) | Viscosity (cps*) | Flash Point (F°) | Appearance |
|---|---|---|---|---|---|
| 0 | 92.7 | 7.3 | 3 | 104.5 | " |
| 0 | 96.3 | 3.7 | 3 | 99.1 | " |

*20 rpm @100° F.

The low or ultra-low viscosity cellulose ether polymer used in Example 2 (The Dow Chemical Co., METHOCEL E2) not only minimizes the water content needed to elevate the flash point of butanol above 103° F. for safety and acceptability as a replacement for odorless kerosene (i.e., petroleum distillate), but also creates a cohesive surface property in the charcoal ignition fluid so that it adheres to the surface of charcoal more readily than is characteristic of n-butanol/water mixtures. Having a similar cohesive surface property reduces the potential for the charcoal ignition fluid disclosed herein to become atomized when dispensed under pressure through a squirt nozzle, thereby greatly improving the safety of the fluid by reducing the potential for flash back (flames rapidly traveling up the stream of fluid if it is squired onto a live fire).

The low or ultra-low viscosity cellulose ether polymer improves the fuel value and combustion efficiency of the result charcoal ignition fluid by replacing the fuel-diminishing impact of water with a combustible oxygenated hydrocarbon from the polymer. This also extends the duration of the flames (combustion period) for the purpose of igniting the charcoal in a manner similar to that provided by odorless kerosene (i.e., petroleum distillate).

The low or ultra-low viscosity cellulose ether polymer reduces the smoke and air pollutants that are emitted by alternative combustible compounds that might be used to elevate the fuel value and flash point of n-butanol but that burn less efficiently. In particular, replacing hydrocarbons that produce toxic byproducts of incomplete combustion, such as PAHs, the charcoal ignition fluid disclosed herein greatly enhances food safety. Moreover, as an ingredient in a consumer product to which many consumers may be exposed, the low or ultra-low viscosity cellulose ether polymer presents an exceedingly low order of toxicity to humans and in the environment. Additionally, the polymer is made from cellulose which is abundant, renewable and does not constitute a potential reduction in the food supply. Both butanol and cellulose ether degrade naturally to carbon dioxide and water in the environment.

In addition, as discussed more fully below, when the cellulose ether polymer is burned in a mixture with butanol in the charcoal ignition fluid, the odor produced is a faint caramel-like smell that is pleasant and very much unlike the off flavors or odors occurring in foods cooked over charcoal ignited with the odorless kerosene or petroleum distillate. Sensory evaluations discussed in Example 4 on foods cooked over separate charcoal grills, one ignited with Kingsford petroleum distillate and one with the charcoal ignition fluid disclosed herein, indicated a unanimous preference for the flavor and odor of the food cooked over the charcoal ignited by the fluid disclosed herein.

Example 3—Absorbance

The purpose of the following Example 3 summarized in Tables 3 and 4 below is to demonstrate that ignition fluids composed of long carbon chains, such as odorless kerosene, with little or no molecular oxygen are not fully "burned off" once absorbed into the porous interior of the standard charcoal briquettes ("SCB"). Conversely, the short oxygenated carbon chains that are the predominant components of the charcoal ignition fluid in the form of cellulose ether polymers and butanol are burned more completely. In Table 3, the lower value for the charcoal ignition fluid in the "Post-Ignition Wt. Loss or Gain" column is explained by the molecular oxygen and water present in the formula diminish the fuel value per gram relative to the unoxygenated hydrocarbons in the kerosene-based fluids. In contrast, the charcoal ignition fluid burns with high efficiency due to the molecular oxygen it contains from the polymer, which provides for adequate ignition of the charcoal. Normal butanol has a 4:1 carbon to oxygen ratio while the other organic component, HPMC (used in Example 3), has a 3:1 carbon to oxygen ratio.

TABLE 3

Comparison of Fluid Absorbed and Residues after Flames Subside Using SCB.

| Brand/Formulation of Charcoal Starter Fluid | Soaked CHB Wt. | Post-Ignition CHB Wt. | Dry CHB Wt. | Wt. of Fluid Absorbed | Post-Ignition Wt. Loss or Gain | Fluid Residue |
|---|---|---|---|---|---|---|
| Backyard Grill | 24.86 g | 19.17 g | 21.55 g | 3.31 g | −2.38 g | Unknown |
| Kingsford | 23.68 | 18.56 | 21.16 | 2.52 | −2.60 | Unknown |
| Smarter Starter | 24.70 | 23.62 | 21.41 | 3.29 | +2.21 | 2.21 g |
| XP2.2NT | 23.71 | 20.17 | 21.04 | 2.67 | −0.87 | Unknown |

Since the charcoal substrate is combustible, its loss of weight from combustion generally tends to compensate for any ignition fluid residue that might be retained in the interior of the charcoal briquette after flames subside. For this reason, a non-combustible ceramic briquette ("NCCB") was selected for the second part of Example 3 as demonstrated below in Table 4.

TABLE 4

Comparison of Fluid Residues after Flames Subside Using NCCB.

| Brand/ Formulation of Charcoal Starter Fluid | Soaked NCCB Wt. | Post-Ignition NCCB Wt. | Dry NCCB Wt. | Wt. of Fluid Absorbed | Post-Ignition Wt. Loss or Gain | Fluid Residue |
|---|---|---|---|---|---|---|
| Backyard Grill | 62.81 g | 62.08 g | 61.35 g | 1.46 g | +0.73 g | 0.73 g |
| Kingsford | 61.23 | 60.45 | 59.69 | 1.54 | +0.76 | 0.76 |
| Smarter Starter | 60.40 | 60.21 | 59.44 | 0.96 | +0.77 | 0.77 |
| XP2.2NT | 60.26 | 59.36 | 59.00 | 1.26 | +0.36 | 0.36 |

The foregoing results demonstrate that the charcoal ignition fluid disclosed herein is absorbed at a rate within 90% of the standard forms of petroleum-based fluid making it virtually indistinguishable from those petroleum-based fluids. The foregoing results further demonstrate the advantageous qualities of the charcoal ignition fluid disclosed herein over gelled alcohols used for the same purpose. Gelled and thickened alcohols that are sometimes used to ignite charcoal are not absorbed into the interior pore spaces in the briquettes, which results in an unfavorable performance rating from most consumers. By reducing the molecular weight of the cellulose ether used in the charcoal ignition fluid disclosed herein to a much lower level, absorbance levels virtually equal to those of petroleum distillates can be achieved.

Example 4—Sensory Evaluation

Sensory evaluations were conducted using the charcoal ignition fluid in a comparison with Kingsford Charcoal Starter Fluid, and the following are the results of a paired comparison taste panel conducted using two types of meat cooked over identical lots of charcoal briquettes under the same temperature and humidity conditions. In this double-blind sensory test, six individuals were asked to complete a consumer sensory evaluation ballot rating on a scale of 1-10, with 10 being most likely and 0 being least likely. The meats selected for the test were ground beef (15% fat) and hot dogs because they have a strong flavor that might make it harder to detect subtle differences in flavor that might be detectable in more delicately flavored foods such as fish or chicken. As illustrated below in Table 5, all six members of the panel identified the food cooked over charcoal ignited by the fluid disclosed herein as having a superior flavor and odor relative to the same meats cooked in an identical manner over charcoal ignited with petroleum distillate (Kingsford Charcoal Starter Fluid).

TABLE 5

| | Overall Appeal | Flavor | Flavor Intensity | Intensity of Salty Flavor | Like/ Dislike of Sample |
|---|---|---|---|---|---|
| Ground Beef (Kingsford) | 42 | 38 | 68 | 74 | 32 |
| Ground Beef (XP2.2NT) | 94 | 92 | 60 | 56 | 92 |
| Hot Dogs (Kingsford) | 38 | 40 | 74 | 66 | 38 |
| Hot Dogs (XP2.2NT) | 96 | 94 | 64 | 58 | 96 |

Whereas, the compounds and methods have been described in relation to the drawings and claims, it should be understood that other and further modifications and formulations, apart from those shown or suggested herein, may be made within the scope of this invention.

What is claimed is:

1. A charcoal ignition fluid, comprising: (a) approximately 1 percent to approximately 15 percent by weight of cellulose ether polymer; (b) butanol; (c) water; and (d) an acetate salt, an organic ester, or a mixture thereof, wherein said charcoal ignition fluid is a liquid.

2. The charcoal ignition fluid of claim 1 wherein said cellulose ether polymer contains a 3:1 carbon-to-oxygen ratio.

3. The charcoal ignition fluid of claim 1 wherein said cellulose ether polymer is both hydrophilic and hydrophobic.

4. The charcoal ignition fluid of claim 1 wherein said cellulose ether polymer is ethyl cellulose, hydroxypropyl methylcellulose, hydroxypropyl cellulose, hydroxybutyl methylcellulose, hydroxyethyl cellulose, hydroxyethyl methylcellulose, hydroxypropyl starch or a mixture thereof.

5. The charcoal ignition fluid of claim 4 wherein said cellulose ether polymer is hydroxypropyl methylcellulose.

6. The charcoal ignition fluid of claim 5 wherein said hydroxypropyl methylcellulose has a number average molecular weight of less than about 15,000.

7. The charcoal ignition fluid of claim 1 wherein said acetate salt comprises sodium acetate, potassium acetate, calcium acetate or a mixture thereof.

8. The charcoal ignition fluid of claim 1 wherein said charcoal ignition fluid has a viscosity of between approximately 3.0 cSt and 23 cSt at 110° F.

9. The charcoal ignition fluid of claim 1 wherein said organic ester comprises butyl acetate, n-butyl acetate or a mixture thereof.

10. The charcoal ignition fluid of claim 1 wherein said butanol is a bio-derived butanol or a petrochemical-derived butanol or a mixture thereof.

11. The charcoal ignition fluid of claim 1 further comprising ethanol.

12. The charcoal ignition fluid of claim 1 further comprising a primary amyl alcohol.

13. The charcoal ignition fluid of claim 12 wherein said primary amyl alcohol comprises pentanol, 1-pentanol, 2-pentanol, 2-methyl-1-butanol, 3-methyl-1-butanol, 2,2,-dimetheyl-1-propanol or a mixture thereof.

14. The charcoal ignition fluid of claim 1 comprising:

approximately 0.4 percent to approximately 15 percent by weight of said cellulose ether polymer;

approximately 70 percent to approximately 95.6 percent by weight of said butanol;

approximately 4 percent to 15 percent by weight of said water; and up to approximately 12 percent by weight of said acetate salt, up to approximately 11 percent by weight of said organic ester, or a mixture thereof.

15. The charcoal ignition fluid of claim 14 further comprising between approximately 1 to approximately 20 percent by weight ethanol.

16. The charcoal ignition fluid of claim 14 further comprising less than approximately 2 percent by weight of a primary amyl alcohol.

17. The charcoal ignition fluid of claim 16 wherein said primary amyl alcohol is pentanol, 1-pentanol, 2-pentanol, 2-methyl-1-butanol, 3-methyl-1-butanol, 2,2,-dimetheyl-1-propanol or a mixture thereof.

18. The charcoal ignition fluid of claim 14 wherein said acetate salt is sodium acetate, potassium acetate, calcium acetate or a mixture thereof.

19. The charcoal ignition fluid of claim 14 wherein said ester is butyl acetate, n-butyl acetate or a mixture thereof.

20. The charcoal ignition fluid of claim 1 comprising:

approximately 1.2 percent to approximately 2.5 percent by weight of said cellulose ether polymer;

approximately 85.95 percent to approximately 92.85 percent by weight of said butanol;

approximately 5.95 percent to approximately 11.55 percent by weight of said water;

up to approximately 7 percent by weight of said acetate salt, up to approximately 7 percent by weight of said organic ester, or a mixture thereof.

21. A charcoal ignition liquid, comprising:

approximately 1.2 percent to approximately 2.5 percent by weight of a cellulose ether polymer, wherein said cellulose ether polymer is both hydrophilic and hydrophobic;

approximately 85.95 percent to approximately 92.85 percent by weight butanol;

approximately 5.95 percent to approximately 11.55 percent by weight water; and ethanol, a primary amyl alcohol, or a mixture thereof.

22. The charcoal ignition liquid of claim 21 wherein said ethanol comprises up to about 7 percent by weight of ethanol.

23. The charcoal ignition liquid of claim 21 wherein said primary amyl alcohol comprises up to about 2 percent by weight of a primary amyl alcohol.

24. The charcoal ignition liquid of claim 23 wherein said primary amyl alcohol is pentanol, 1-pentanol, 2-pentanol, 2-methyl-1-butanol, 3-methyl-1-butanol, 2,2,-dimetheyl-1-propanol or a mixture thereof.

25. The charcoal ignition liquid of claim 21 further comprising up to approximately 7 percent by weight of an acetate salt.

26. The charcoal ignition liquid of claim 25 wherein said acetate salt is sodium acetate, potassium acetate, calcium acetate or a mixture thereof.

27. The charcoal ignition liquid of claim 21 further comprising up to approximately 7 percent by weight of an organic ester.

28. The charcoal ignition liquid of claim 27 wherein said ester is butyl acetate, n-butyl acetate or a mixture thereof.

29. The charcoal ignition liquid of claim 21 wherein said charcoal ignition liquid has a viscosity of between approximately 3.0 cSt and 23 cSt at 110° F.

30. The charcoal ignition liquid of claim 21 wherein said cellulose ether polymer is ethyl cellulose, hydroxyethyl cellulose, hydroxypropyl methylcellulose, hydroxypropyl cellulose, hydroxybutyl methylcellulose, hydroxyethyl methylcellulose, hydroxypropyl starch or a mixture thereof.

31. The charcoal ignition liquid of claim 30 wherein said cellulose ether polymer is hydroxypropyl methylcellulose.

32. The charcoal ignition liquid of claim 21 wherein said butanol is a bio-derived butanol, a petrochemical-derived butanol or a mixture thereof.

33. The charcoal ignition fluid of claim 10 wherein said butanol is n-butanol, 2-butanol, isobutanol or a mixture thereof.

34. The charcoal ignition liquid of claim 32 wherein said butanol is n-butanol, 2-butanol, isobutanol or a mixture thereof.

35. The charcoal ignition fluid of claim 6 wherein said hydroxypropyl methylcellulose has a number average molecular weight of between about 5,000 and about 10,000.

36. The charcoal ignition fluid of claim 6 wherein said hydroxypropyl methylcellulose has a number average molecular weight of between about 1,000 and about 5,000.

37. The charcoal ignition liquid of claim 31 wherein said hydroxypropyl methylcellulose has a number average molecular weight of less than about 15,000.

38. The charcoal ignition liquid of claim 37 wherein said hydroxypropyl methylcellulose has a number average molecular weight of between about 1,000 and about 5,000.

39. The charcoal ignition liquid of claim 37 wherein said hydroxypropyl methylcellulose has a number average molecular weight of between about 5,000 and about 10,000.

40. The charcoal ignition fluid of claim 8 wherein said charcoal ignition fluid has a viscosity of between approximately 6.5 cSt and 23 cSt at 110° F.

41. The charcoal ignition liquid of claim 29 wherein said charcoal ignition liquid has a viscosity of between approximately 6.5 cSt and 23 cSt at 110° F.

42. A charcoal ignition liquid, comprising: (a) hydroxypropyl methylcellulose: (b) butanol; (c) water; and (d) an acetate salt, an organic ester, or a mixture thereof.

43. The charcoal ignition liquid of claim 42 wherein said hydroxypropyl methylcellulose has a number average molecular weight of less than about 15,000.

44. The charcoal ignition liquid of claim 43 wherein said hydroxypropyl methylcellulose has a number average molecular weight of between about 5,000 and about 10,000.

45. The charcoal ignition liquid of claim 43 wherein said hydroxypropyl methylcellulose has a number average molecular weight of between about 1,000 and about 5,000.

46. The charcoal ignition liquid of claim 42 wherein said acetate salt comprises sodium acetate, potassium acetate, calcium acetate or a mixture thereof.

47. The charcoal ignition liquid of claim 42 wherein said charcoal ignition fluid has a viscosity of between approximately 3.0 cSt and 23 cSt at 110° F.

48. The charcoal ignition liquid of claim 47 wherein said charcoal ignition liquid has a viscosity of between approximately 6.5 cSt and 23 cSt at 110° F.

49. The charcoal ignition liquid of claim 42 wherein said primary amyl alcohol comprises butyl acetate, n-butyl acetate or a mixture thereof.

50. The charcoal ignition liquid of claim 42 wherein said butanol is a bio-derived butanol or a petrochemical-derived butanol or a mixture thereof.

51. The charcoal ignition liquid of claim 42 further comprising ethanol.

52. The charcoal ignition liquid of claim 42 further comprising a primary amyl alcohol.

53. The charcoal ignition liquid of claim 52 further wherein said primary amyl alcohol comprises pentanol, 1-pentanol, 2-pentanol, 2-methyl-1-butanol, 3-methyl-1-butanol, 2,2,-dimetheyl-1-propanol or a mixture thereof.

54. The charcoal ignition liquid of claim 42 comprising:

(a) approximately 0.4 percent to approximately 15 percent by weight of said hydroxypropyl methylcellulose;

(b) approximately 70 percent to approximately 95.6 percent by weight of said butanol;

(c) approximately 4 percent to 15 percent by weight of said water;

(d) up to approximately 12 percent by weight of said acetate salt, up to approximately 11 percent by weight of said organic ester, or a mixture thereof.

55. The charcoal ignition liquid of claim 42 comprising:
(a) approximately 1.2 percent to approximately 2.5 percent by weight of said hydroxypropyl methylcellulose;
(b) approximately 85.95 percent to approximately 92.85 percent by weight of said butanol;
(c) approximately 5.95 percent to approximately 11.55 percent by weight of said water;
(d) up to approximately 12 percent by weight of said acetate salt, up to approximately 11 percent by weight of said organic ester, or a mixture thereof.

56. The charcoal ignition liquid of claim 54 further comprising between approximately 1 to approximately 20 percent by weight ethanol.

57. The charcoal ignition liquid of claim 54 further comprising less than approximately 2 percent by weight of a primary amyl alcohol.

58. A charcoal ignition liquid, comprising: (a) hydroxypropyl methylcellulose; (b) butanol; (c) water; and (d) ethanol, a primary amyl alcohol or a mixture thereof.

59. The charcoal ignition liquid of claim 58 wherein said hydroxypropyl methylcellulose has a number average molecular weight of less than about 15,000.

60. The charcoal ignition liquid of claim 59 wherein said hydroxypropyl methylcellulose has a number average molecular weight of between about 5,000 and about 10,000.

61. The charcoal ignition liquid of claim 59 wherein said hydroxypropyl methylcellulose has a number average molecular weight of between about 1,000 and about 5,000.

62. The charcoal ignition liquid of claim 58 further comprising an acetate salt.

63. The charcoal ignition liquid of claim 62 wherein said acetate salt comprises sodium acetate, potassium acetate, calcium acetate or a mixture thereof.

64. The charcoal ignition liquid of claim 58 wherein said charcoal ignition fluid has a viscosity of between approximately 3.0 cSt and 23 cSt at 110° F.

65. The charcoal ignition liquid of claim 64 wherein said charcoal ignition liquid has a viscosity of between approximately 6.5 cSt and 23 cSt at 110° F.

66. The charcoal ignition fluid of claim 42 further comprising a primary amyl alcohol.

67. The charcoal ignition liquid of claim 66 wherein said primary amyl alcohol comprises butyl acetate, n-butyl acetate or a mixture thereof.

68. The charcoal ignition liquid of claim 58 wherein said butanol is a bio-derived butanol or a petrochemical-derived butanol or a mixture thereof.

69. The charcoal ignition liquid of claim 58 further wherein said primary amyl alcohol comprises pentanol, 1-pentanol, 2-pentanol, 2-methyl-1-butanol, 3-methyl-1-butanol, 2,2,-dimetheyl-1-propanol or a mixture thereof.

70. The charcoal ignition liquid of claim 58 comprising:
(a) approximately 0.4 percent to approximately 15 percent by weight of said hydroxypropyl methylcellulose;
(b) approximately 70 percent to approximately 95.6 percent by weight of said butanol;
(c) approximately 4 percent to 15 percent by weight of said water;
(d) approximately 1 to approximately 20 percent by weight ethanol, less than approximately 2 percent by weight of a primary amyl alcohol, or a mixture thereof.

71. The charcoal ignition liquid of claim 58 comprising:
(a) approximately 1.2 percent to approximately 2.5 percent by weight of said hydroxypropyl methylcellulose;
(b) approximately 85.95 percent to approximately 92.85 percent by weight of said butanol;
(c) approximately 5.95 percent to approximately 11.55 percent by weight of said water;
(d) approximately 1 to approximately 20 percent by weight ethanol, less than approximately 2 percent by weight of a primary amyl alcohol, or a mixture thereof.

72. The charcoal ignition liquid of claim 71 further comprising up to approximately 12 percent by weight of an acetate salt.

73. The charcoal ignition liquid of claim 71 further comprising up to approximately 11 percent by weight of an organic ester.

* * * * *